US008312586B2

(12) United States Patent
Chen

(10) Patent No.: US 8,312,586 B2
(45) Date of Patent: Nov. 20, 2012

(54) DEVICE FOR HOLDING CLEANING IMPLEMENTS

(76) Inventor: James Chen, Chino, CA (US)

( * ) Notice: Subject to any disclaimer, the term of this patent is extended or adjusted under 35 U.S.C. 154(b) by 301 days.

(21) Appl. No.: 12/859,151

(22) Filed: Aug. 18, 2010

(65) Prior Publication Data

US 2012/0042465 A1 Feb. 23, 2012

(51) Int. Cl.
*A47K 7/02* (2006.01)

(52) U.S. Cl. ..... 15/209.1; 15/244.1; 15/147.2; 15/229.11

(58) Field of Classification Search ..... 15/147.1, 15/147.2, 209.1, 210.1, 229.11, 229.13, 244.1, 15/231, 211, 104.165, 236.03, 236.07, 236; 81/13, 44, 58.1, 119, 120, 177.1; D8/16–19
See application file for complete search history.

(56) References Cited

U.S. PATENT DOCUMENTS

| | | | | |
|---|---|---|---|---|
| 1,815,804 | A * | 7/1931 | Siess et al. | 81/58.2 |
| 2,719,451 | A * | 10/1955 | Zygmunt | 84/312 R |
| 3,060,478 | A * | 10/1962 | Silver | 15/229.13 |
| D247,075 | S * | 1/1978 | Krusche | D4/117 |
| 4,244,075 | A * | 1/1981 | Silver | 15/145 |
| 6,276,022 | B1 * | 8/2001 | Gallacher | 15/209.1 |
| 6,370,723 | B1 * | 4/2002 | Chang | 15/110 |
| 6,748,620 | B2 * | 6/2004 | Ching-Chen | 15/110 |
| D540,042 | S * | 4/2007 | Ajootian | D4/138 |
| 7,469,442 | B1 * | 12/2008 | Matheson | 15/209.1 |
| 7,966,913 | B2 * | 6/2011 | Vollenweider | 81/120 |
| 2004/0237238 | A1 * | 12/2004 | Huang | 15/209.1 |
| 2005/0028310 | A1 * | 2/2005 | Huang | 15/209.1 |
| 2006/0168750 | A1 * | 8/2006 | Dotterman et al. | 15/228 |
| 2007/0136971 | A1 * | 6/2007 | Dickman | 15/209.1 |
| 2008/0028555 | A1 * | 2/2008 | Petner et al. | 15/118 |
| 2008/0245193 | A1 * | 10/2008 | Lipka | 81/58.2 |
| 2009/0007732 | A1 * | 1/2009 | Hsieh | 81/120 |
| 2011/0010884 | A1 * | 1/2011 | Nagata et al. | 15/210.1 |
| 2011/0162486 | A1 * | 7/2011 | Lee et al. | 81/58.2 |

* cited by examiner

*Primary Examiner* — William Gilbert
*Assistant Examiner* — Alp Akbasli
(74) *Attorney, Agent, or Firm* — James A. Italia; Italia IP

(57) ABSTRACT

A device for holding and manipulating compressible cleaning implements is disclosed wherein the cleaning implements may be made from a compressible material and may have a compressible portion. The device may include a handle. A blade may be attached to the handle. An outer blade edge may surround the blade. An opening through the blade may be defined by an inner blade edge. A channel may pass through the blade and may extend from the inner blade edge to the outer blade edge, and may be defined by a first channel edge and a second channel edge. The compressible portion of the cleaning implement may be passed through the channel into the opening and may be held in the opening by engagement with the inner blade edge. Each of the first and second channel edges may respectively define first and second circumferentially directed points configured to poke into the compressible material.

19 Claims, 6 Drawing Sheets

DEVICE FOR HOLDING CLEANING IMPLEMENTS

CROSS-REFERENCE TO RELATED APPLICATION

This application claims the benefit of the filing date under 35 USC 119(e) of the filing date of U.S. Provisional application Ser. No. 12/543,702, filed Aug. 19, 2009, the contents of which are incorporated herein by reference.

FIELD OF THE INVENTION

This application relates generally to cleaning implements, and more specifically to a device for holding cleaning implements such as those used in bathing, dishwashing, and other cleaning tasks which includes one or more features to minimize relative movement between a cleaning implement and the holder.

BACKGROUND AND SUMMARY

Cleaning implements such as sponges, mesh balls, applicators, and similar flexible compressible porous and permeable materials commonly are used to clean the skin of people and animals, as well as to clean inanimate objects. While it is usually is quite easy to apply soap to these cleaning implements, and to apply them in a scrubbing manner by means of the user's hands, it very often is not so easy to get them into positions where they can be placed into contact with the surface to be cleaned, such the back of a bather or the interior of a bottle or jar. In addition, some cleaning solutions are very hot, or are caustic or the like, in which case the user needs to protect his or her hands. While this may be done with gloves, the problem of reaching inaccessible places remains.

Further, the effectiveness of using a cleaning implement to clean any object depends on the level of control the user has over the interaction between the surfaces of the cleaning implement and the surfaces the object being cleaned. For example, if the cleaning implement is allowed to slide, or rotate, relative to the surface being cleaned in ways not controllable to the user, then the interactive rubbing action, for example, of the implement relative to the surface may be less than optimal.

Thus, what is needed is a means for holding and manipulating such cleaning implements that addresses the aforementioned problems. Such a device would assist a user in cleaning hard-to-reach locations while allowing the cleaning implements to readily be attached and detached, and while providing a degree of translational and rotational stability between the cleaning implement and the holder.

This application discloses a holder form holding cleaning implements that is economical to produce, of simple construction and capable of mass production, but also capable of providing a holder of cleaning implements that is capable of extending a users reach and that holds the cleaning implements in a stable fashion.

In particular, this application discloses a device for holding and manipulating compressible cleaning implements is disclosed wherein the cleaning implements may be made from a compressible material and may have a compressible portion. The device may include a handle. A blade may be attached to the handle. An outer blade edge may surround the blade. An opening through the blade may be defined by an inner blade edge. A channel may pass through the blade and may extend from the inner blade edge to the outer blade edge, and may be defined by a first channel edge and a second channel edge.

The compressible portion of the cleaning implement may be passed through the channel into the opening and may be held in the opening by engagement with the inner blade edge. Each of the first and second channel edges may respectively define first and second circumferentially directed points configured to poke into the compressible material

BRIEF DESCRIPTION OF THE DRAWINGS

The drawings, when considered in conjunction with the following description, are presented for the purpose of facilitating an understanding of the invention sought to be protected.

DETAILED DESCRIPTION

Figure 1:
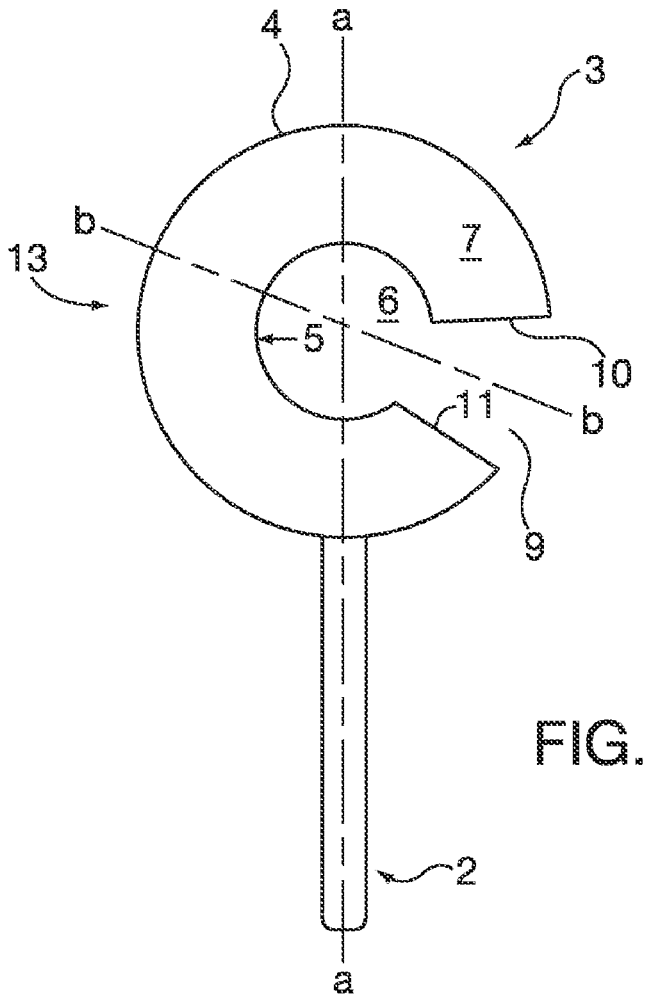
FIG. 1 is a top view of a first example embodiment of a device for holding scrubbing implements in accordance with the present disclosure.
Figure 2:
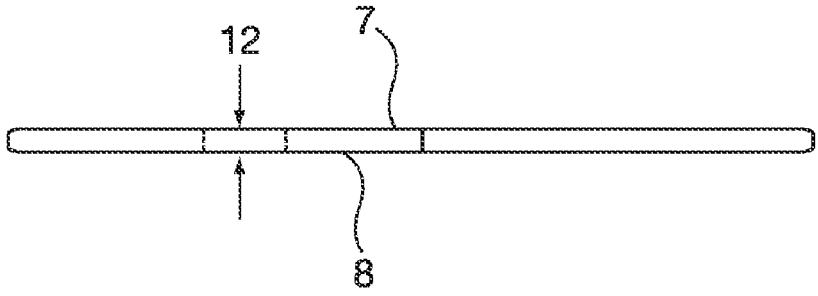
FIG. 2 is a side view of the device of FIG. 1.

The following description is of a preferred embodiment of the invention. As shown in FIG. 1, the cleaning implement holding device comprises a handle 2 and a blade 3. Handle 2 can be of any desirable shape, size and length. For example, its cross-section can be circular or otherwise curvilinear, rectangular, or other suitable configuration, and it can be straight or curved. It can be made of any desirable material, such as wood, metal or plastic. Blade 3 has an outer blade edge 4 outlining its periphery, and an inner blade edge 5, which defines a central opening 6. Opening 6 may be any desirable shape, but preferably is circular. Blade 3 may be of any suitable shape, and is shown here in a preferred circular shape, and it may be stiff or flexible. Blade 3 has a first face 7 and a second face 8. A channel 9 extends radially between outer edge 4 and inner edge 5, bounded by a first channel edge 10 and a second channel edge 11. Channel 9 can be of constant width along its length, but advantageously is tapered outwardly from inner blade edge 5 to outer blade edge 4. The width of channel 9 at inner blade edge 5 is less than the maximum dimension of opening 6, which is the diameter if opening 6 is circular. The thickness 12 of blade 3 (FIG. 2) is such that it engages and grips both of the portions of the cleaning implement, and the width 13 is sufficient to provide backing support for the cleaning implement when it is pressed against a surface in a scrubbing manner. The taper of channel 9 is sufficient to allow the cleaning implement to be inserted into opening 6. Handle 2 and blade 3 can be attached together by any suitable means, or can be molded together as a single element.

It is probable that the vast majority of the scrubbing strokes applied by the user to the inventive device will be back and forth along the direction of the longitudinal axis of handle 2. For this reason, while channel 9 can be located anywhere on blade 3, it is advantageous to position the central axis of channel 9 at such an angle to the longitudinal axis of handle 2 as to minimize the tendency of the forces acting upon the cleaning implement during longitudinal scrubbing strokes to cause the cleaning implement to migrate from opening 6 into channel 9. A line a-a is shown in FIG. 1 through the longitudinal axis of handle 2, and a line b-b denotes the center axis of channel 9. An angle of 90 degrees between the two would provide maximum protection against outward migration during the said back and forth scrubbing strokes, but would minimize such protection during the less common side to side scrubbing strokes. It is preferred to orient channel 9 at a substantial angle to the axis of handle 2, that is, with channel axis b-b being within a range of 45 to 60 degrees from a line through handle axis a-a. An angle between line a-a and line b-b that is very effective in balancing the various scrubbing patterns that can be expected is about 60 degrees, as is illustrated in FIG. 1.

In order to effectively accommodate the most commonly used cleaning instruments, preferred dimensions for the components are as follows: The length of handle 2 is in the range of 12-18 inches. The length of blade 3 is in the range of 3-8 inches and the width is in the range of 3-6 inches. The diameter of opening 6 is in the range of 1-3 inches, and the width of channel 9 is in the range of 0.5 to 2.5 inches. The thickness of blade 6 is selected to allow the blade to flex somewhat while still providing backing for the cleaning implement.

Figure 3:
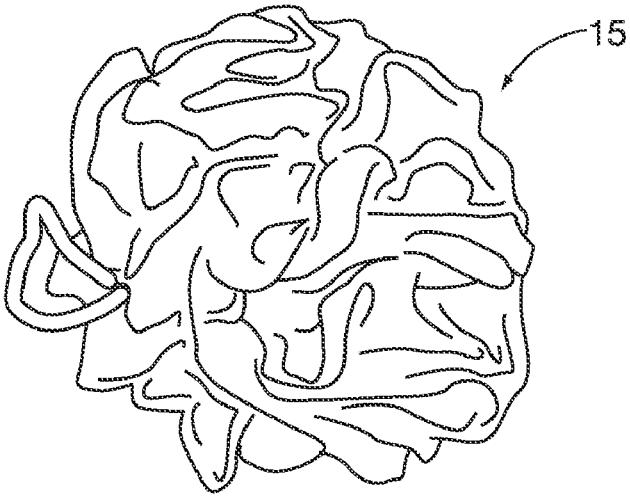
FIG. 3 is a perspective view of a mesh ball cleaning implement that can be used in conjunction with the device shown in FIGS. 1 and 2.
Figure 4:
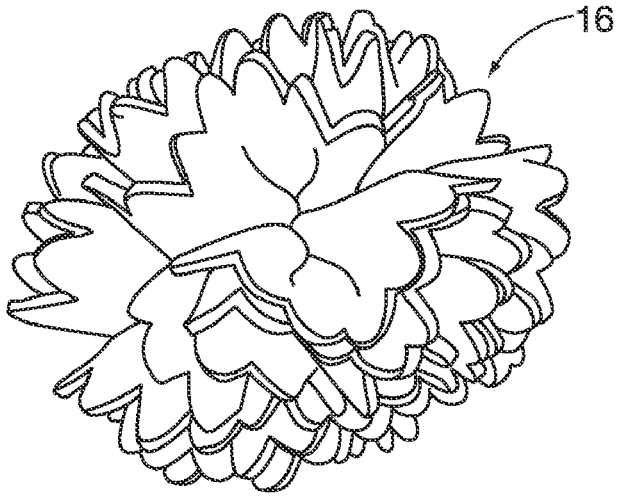
FIG. 4 is a perspective view of a layered cloth cleaning implement that can be used in conjunction with the device shown in FIGS. 1 and 2.
Figure 5:
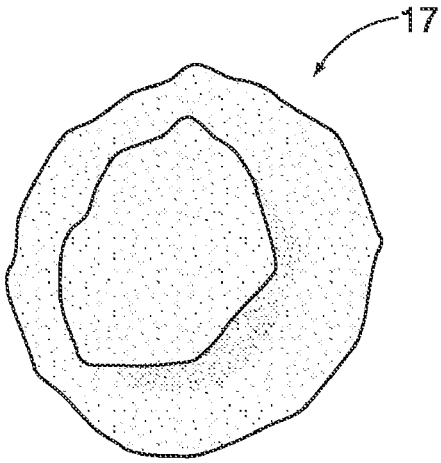
FIG. 5 is a perspective view of a contoured sponge cleaning implement that can be used in conjunction with the device shown in FIGS. 1 and 2.
Figure 6:
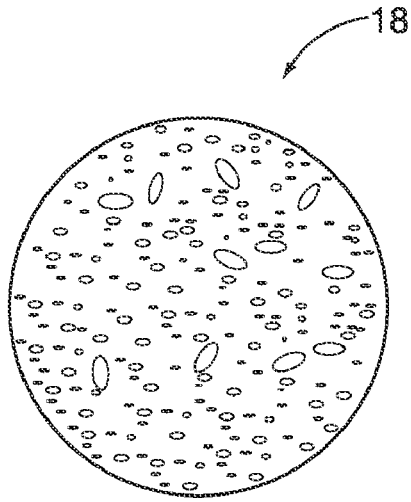
FIG. 6 is a perspective view of a round sponge cleaning implement that can be used in conjunction with the device shown in FIGS. 1 and 2.

Illustrated in FIGS. 3 through 7 are examples of types of cleaning implements that are usable in the inventive device. FIG. 3 shows a mesh pouf 15, which commonly is used by a person in the shower. It comprises a plurality of layers of mesh material, joined together at a central core. FIG. 4 shows a layered sponge 16, which also is held together at a central core. The implement shown in FIG. 5 is a contoured sponge 17, and that of FIG. 6 is a common round sponge 18.

Figure 8:
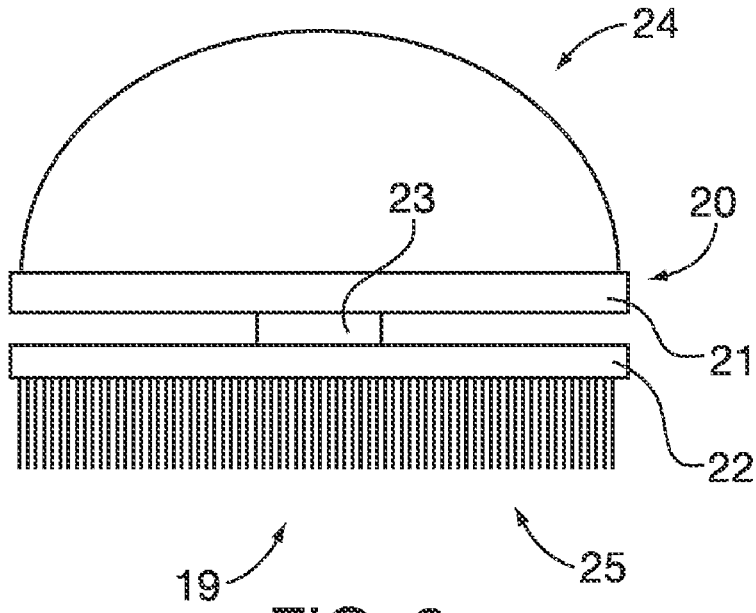
FIG. 8 is a perspective view of a cleaning implement having a hemispherical cleaning pad on one side and brush bristles on the opposite side.
Figure 9:
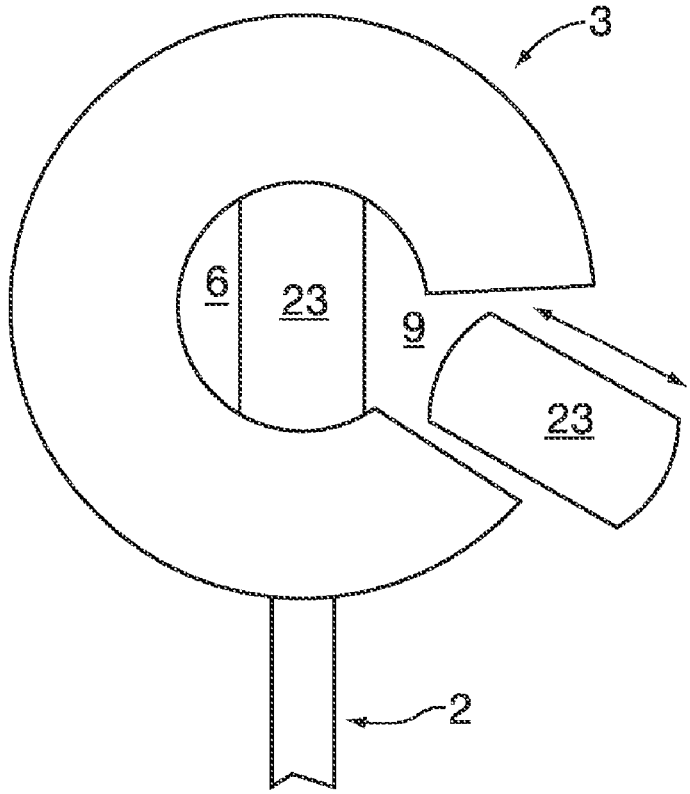
FIG. 9 is a schematic illustration of the means by which the cleaning implement of FIG. 8 is attached to the device shown in FIGS. 1 and 2.

Another type of cleaning implement 19 that can be used in the invention is shown in FIG. 8. With implement 19, different types of cleaning devices can be presented on either side of blade 3, and applied to surfaces to be cleaned by flipping over blade 3. In this example, a base element 20 is provided with spaced circular mounting panels 21 and 22, which are attached together at their centers by a rectangular attachment element 23. Element 23 is at least slightly compressible and its uncompressed length is greater than the diameter of opening 9. For illustrative purposes, a sponge 24 is shown as being attached to panel 21 and brush bristles to panel 22. To install implement 19, attachment element 23 is inserted longitudinally through channel 9, and then the implement is rotated to compress element 23 and frictionally lock it in opening 6.

Figure 7:
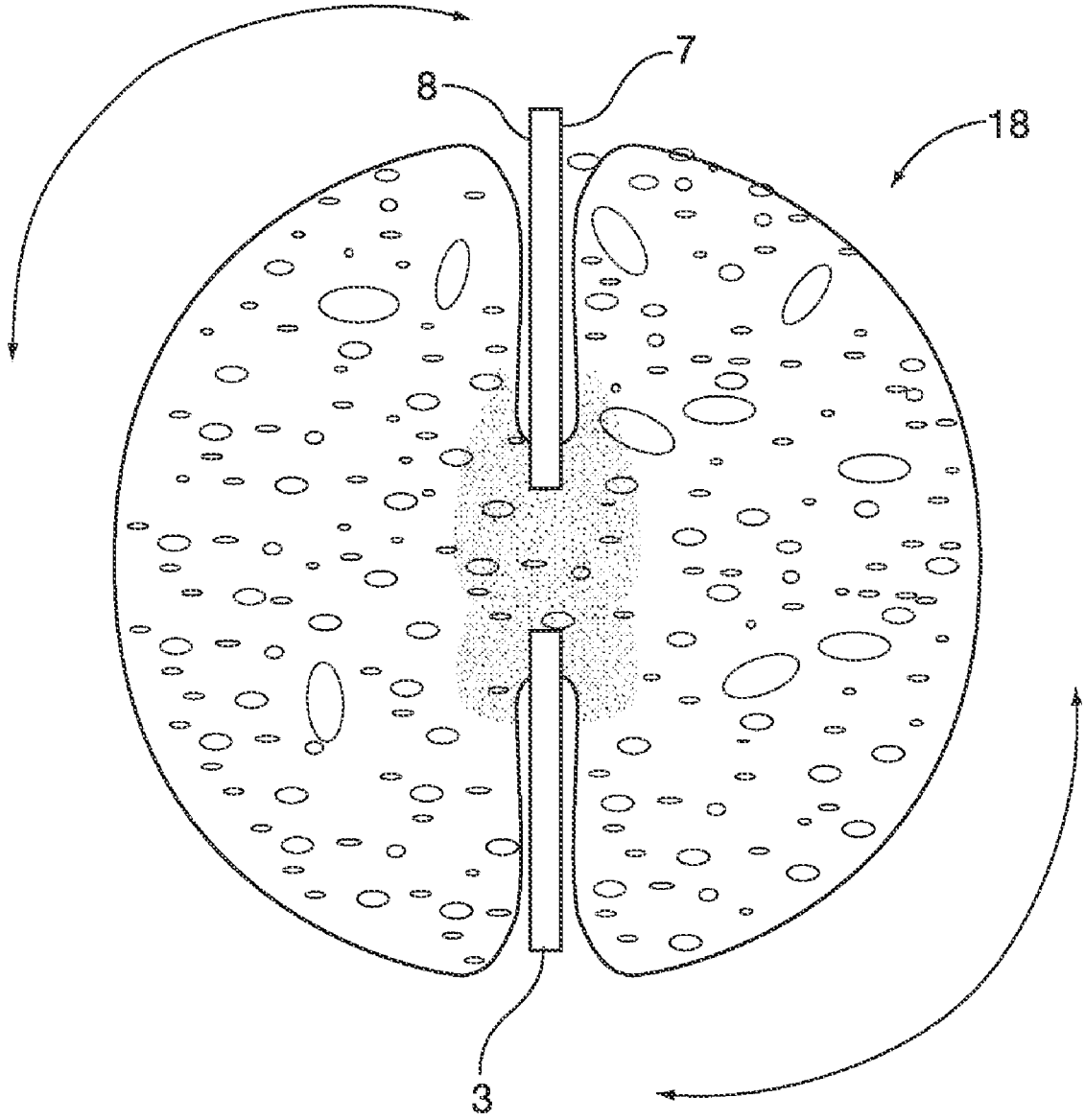
FIG. 7 illustrates the relationship between the device and a cleaning implement installed therein.

The principle of operation of the inventive device is to hold a compressible portion of a cleaning implement in place in blade 3 by squeezing that portion of the implement into opening 6, where the implement is held in place by friction at the area of reduced radius. This is accomplished by pressing the compressible portion of the cleaning implement through channel 9 until it reaches opening 6, where it expands to fill opening 6. Because the width of channel 9 is less than the diameter of opening 6, the cleaning implement cannot easily migrate outwardly through channel 9 during use. The outwardly tapered edges 10 and 11 of channel 9 make it easier for the user to insert the appropriate portion of the cleaning implement into the channel. The size of opening 6 must be less than the diameter of the implement that is being held therein, so that once in channel 6 it is secured by friction and by the expanded portions that now are present on either side of blade 3. By way of example, a portion of the sponge 18 shown in FIG. 6 is pressed into channel 9 and is deformed while being squeezed through the channel until it arrives in opening 6, where it expands to such an extent as to completely fill opening 6. The result of this procedure is shown in FIG. 7. Once in place, the cleaning implements are held securely to withstand the forces placed upon them by the cleaning process. In this regard, locating channel 9 in the portion of blade 3 that is proximal to the point at which handle 2 is attached provides added protection against the implement being dislodged when cleaning strokes are made along the longitudinal axis of the handle are applied. Inner edge 5 of blade 3 can be blunt, or it can be tapered to allow it to cut into the inserted cleaning implement. The same is true of channel edges 10 and 11.

Figure 10:
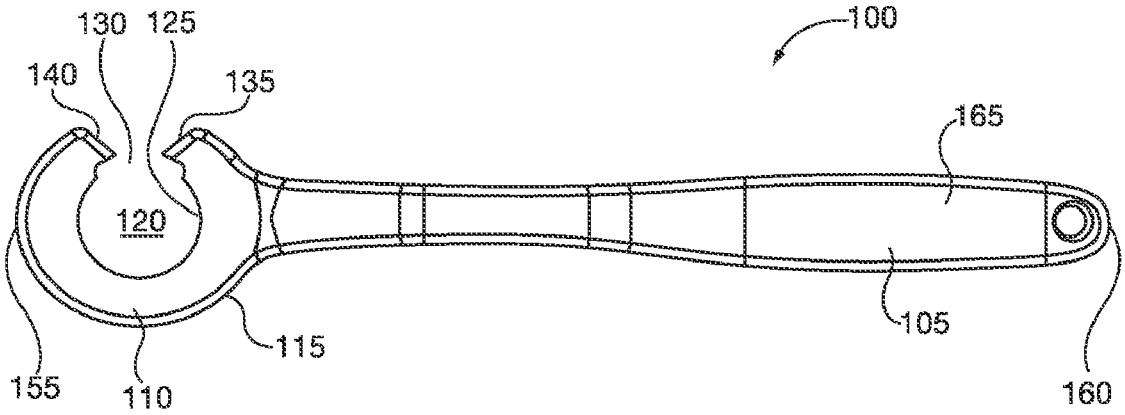
FIG. 10 is a top view of another embodiment of the device in accordance with the present disclosure.
Figure 11:
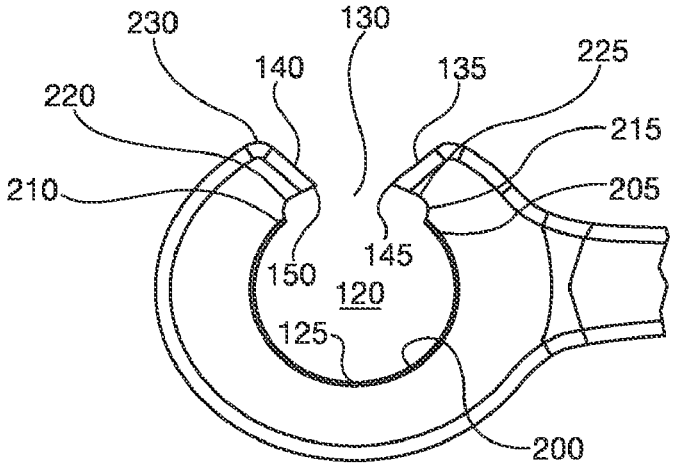
FIG. 11 is blown up top view of a portion of FIG. 10 showing more detail thereof.

FIG. 10 is a top view of another embodiment of the device 100 for holding a cleaning implement in accordance with the present disclosure, and FIG. 11 is a detailed view thereof. The cleaning implement may be made from a compressible material and may have a compressible portion. The device 100 may include a handle 105. A blade 110 may be attached to the handle 105. An outer blade edge 115 may surround the blade 110. An opening 120 through the blade 120 may be defined by an inner blade edge 125. A channel 130 may pass through the blade 120 and may extend from the inner blade edge 125 to the outer blade edge 115. The channel 130 may be defined by a first channel edge 135 and a second channel edge 140. The compressible portion of the cleaning implement can be passed through the channel 130 into the opening 120 and may be held in the opening 120 by engagement with the inner blade edge. Each of the first and second channel edges 135, 140 may respectively define first and second circumferentially directed points 145, 150 configured to poke into the compressible material. The first and second circumferentially directed points 145, 150 may substantially point at one another.

In this way, the cleaning implement may be substantially prevented from rotating within the opening 120. This may then provide enhanced stability of the cleaning implement relative to the device for holding the cleaning implement 100. The points 145, 150 may also, or instead, aid in keeping the cleaning implement within the opening 120.

Figure 12:
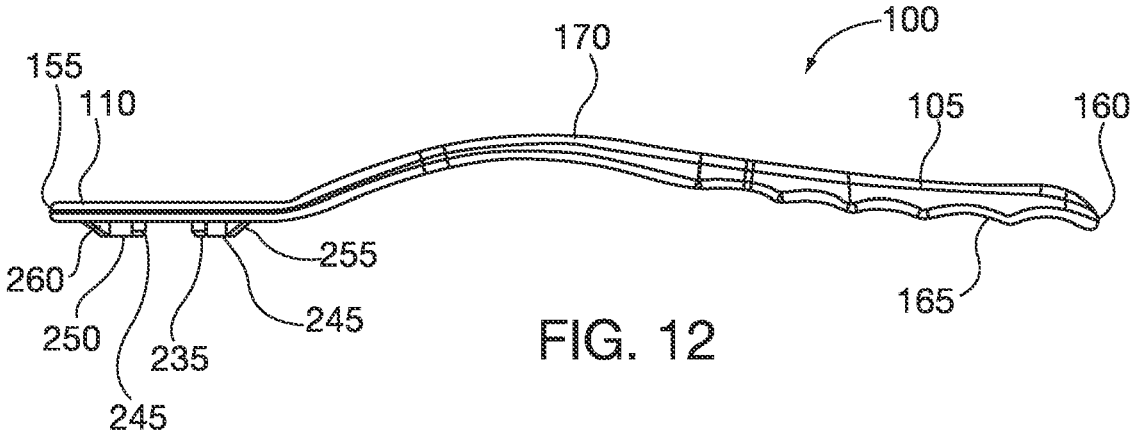
FIG. 12 is side view of a portion of the device shown in FIG. 10.

FIG. 12 is a side view of the device illustrated in FIGS. 10 and 11. The device 100 may have a first end 155 and a second end 160. The blade 110 may be at the first end 155. The handle 105 may include a gripping portion 165 at the second end 160 that may be configured to be gripped by a user. The handle 105 may have a bowed middle portion 170 between the first end 155 and the second end 160. The bowed middle portion 170 may provide some flexibility to the device 100. The overall shape of the device 100 may enable a user to access surfaces that may be otherwise difficult to reach.

Figure 13:
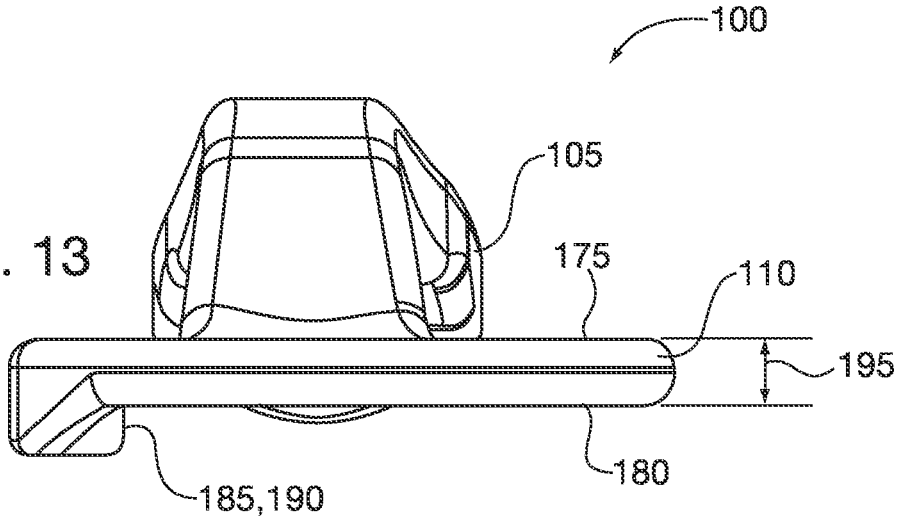
FIG. 13 is an end view of a portion of the device shown in FIG. 10.
Figure 14:
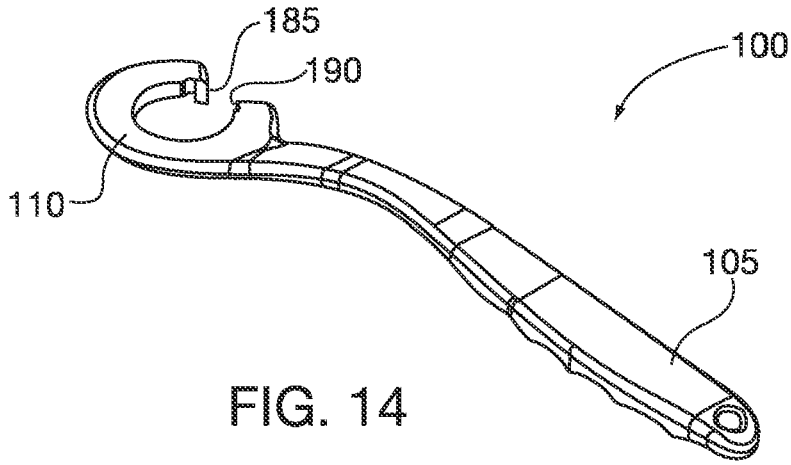
FIG. 14 is a perspective view of a portion of the device shown in FIG. 10.

Turning now, in particular, to FIGS. 13 and 14 wherein and edge view and a perspective view of the device shown in FIGS. 10-12 are respectively illustrated.

The handle 105 may have oppositely oriented first and second blade faces 175, 180. The first and second circumferentially directed points 145, 150 may be respectively first and second linear edges 185, 190 extending substantially normal to said first blade face 175.

A distance 195 between said first blade face 175 and said second blade face 180 may define a thickness 195 of said blade 110, and wherein said first and second linear edges 185, 190 may be longer than the thickness 195 of the blade 110. In some examples the first and second linear edges 185, 190 may be substantially twice as long as the thickness 195 of said blade 110.

Referring again, in part to FIG. 11, the inner blade edge 125 may include an annular curved face 200 extending substantially three fourths of a way around a complete circle circumscribing said opening 120. The annular curved face 200 may terminate at opposed ends 205, 210. First and second curved surfaces 215, 220 may each start at and may form an outside corner with each of said respective opposed ends 205, 210, and each may extend radially and circumferentially from each of the opposed ends 205, 210. First and second faces 225, 230 may extend substantially circumferentially from each of the curved surfaces, and each may form respective first and second inside surfaces of the first and second circumferentially directed points 145, 150.

The first channel edge 135 may form a first acute angle with said first face thereby forming said first point 145. The, second channel edge 140 may form a second acute angle with said second face thereby forming said second point 150.

In some examples, the distance between said first channel edge and said second channel edge may increases from said first and second points to said outer blade edge. The opening may have a maximum opening width and a distance between said first point and said second point may be less than said maximum opening width.

In some examples the cleaning implement may be of sponge material. In some examples the cleaning implement may be of layered mesh material. In some examples, the cleaning implement may be an applicator.

In some examples the device 100 may also include first and second channel ridges 235, 240 integrally formed with an underside 180 of each respective first and second channels 135, 140. The first and second channel ridges 235, 240 may serve to increase the surface area of the first and second channels which may make it easier to push a cleaning implement into the channel.

In some examples the device 100 may also first and second circumferential ridges 245, 250 each extending respectively from the first and second channel ridges and formed integrally with an underside of the blade 110.

In some examples the device 100 may also include first and second ramp sections 255, 260 each extending respectively from the first and second circumferential ridges. Each ramp section may having a ramping face extending from a surface on each circumferential ridge. The surface may be distal from the underside 180 of the blade 110, and each ramping face may ramp progressively closer to the underside 180 and smoothly terminating at the underside 180. The first and second circumferential ridges 245, 250 may serve to add stability and strength to the channel mouth. The channel ridges 235, 240 and/or the circumferential ridges 245, 250 may also serve to keep the cleaning implement from coming out of the opening 120.

Other example embodiments may provide a device 100 for holding a cleaning implement that may include a handle 105 and a blade 110 attached to the handle 105. An outer blade edge 115 may surround the blade 110. An opening 120 through the blade may be defined by an inner blade edge 125. The inner blade edge 125 may have a circumferential contour 200. The inner blade edge 125 may include first and second notched portions each serving to increase the circumferential contour 200 of the inner blade edge 125. A channel 130 may pass through the blade 110 and may extend from the first and second notched portions to said outer blade edge 115. The channel may be defined by a first channel edge 135 and a second channel edge 140. Each of the first channel edge 135 and the second channel edge 140 may respectively meet the respective first and second notched portions at respective first and second circumferentially directed points 145, 150.

Other example embodiments may provide a device 100 for holding a cleaning implement. The cleaning implement made from a compressible material and may have a compressible portion. The device may include a handle 105 and a blade 110 attached to the handle 105. An outer blade edge 115 may surround the blade 110. An opening 120 may pass through the blade may be defined by an inner blade edge 125. A channel 130 may pass through said blade and may extend from said inner blade edge to said outer blade edge. The channel 130 may be defined by a first channel edge 135 and a second channel edge 140. A first point 145 may be formed at an intersection of said inner blade edge and said first channel edge. A second point 150 may be formed at an intersection of said inner blade edge and said second channel edge. The first and second points 145, 150 may define oppositely directed barbs 145, 150 directed substantially toward one another. The barbs 145, 150 may be configured to protrude into the compressible material of the cleaning implement to oppose rotational movement of the cleaning implement.

While the present invention has been described in connection with what are considered practical and preferred embodiments, it is to be understood that it is not to be limited to the disclosed arrangements, but is intended to cover various arrangements which are included within the spirit and scope of the broadest possible interpretation of the appended claims so as to encompass all modifications and equivalent arrangements.

What is claimed is:

1. A device for holding a cleaning implement, the cleaning implement made from a compressible material and having a main body, the device comprising:

a handle; and a cleaning implement, wherein said main body is made of a material selected from a group consisting of a mesh material, a layered sponge, a contoured sponge, and a round sponge;

a blade attached to said handle, an outer blade edge surrounding said blade, an opening through said blade defined by an inner blade edge, and a channel through said blade and extending from said inner blade edge to said outer blade edge, said channel being defined by a first channel edge and a second channel edge;

whereby the main body of said cleaning implement passes through said channel into said opening and is held in said opening by engagement with said inner blade edge; and wherein each of said first and second channel edges respectively define first and second circumferentially directed points configured to poke into said material.

2. The device of claim 1, wherein said first and second circumferentially directed points substantially point at one another.

3. The device of claim 1, wherein the device has a first end and a second end, the blade being at the first end, and wherein the handle include a gripping portion at the second end configured to be gripped by a user, the handle having a bowed middle portion between the first end and the second end.

4. The device of claim 1, wherein said handle has oppositely oriented first and second blade faces, and wherein said first and second circumferentially directed points are respectively first and second linear edges extending substantially normal to said first blade face.

5. The device of claim 4, wherein a distance between said first blade face and said second blade face defines a thickness of said blade, and wherein said first and second linear edges are longer than said thickness of said blade.

6. The device of claim 4, wherein said first and second linear edges are substantially twice as long as said thickness of said blade.

7. The device of claim 1, wherein said inner blade edge includes an annular curved face extending substantially three fourths of a way around a complete circle circumscribing said opening, said annular curved face terminating at opposed ends, first and second curved surfaces each starting at and forming an outside corner with each of said respective opposed ends, and each extending radially and circumferentially from each of said opposed ends, first and second faces extending substantially circumferentially from each of the curved surfaces, and each forming respective first and second inside surfaces of said first and second circumferentially directed points.

8. The device of claim 7, wherein said first channel edge forms a first acute angle with said first face thereby forming said first point, and wherein said second channel edge forms a second acute angle with said second face thereby forming said second point.

9. The device of claim 1, wherein the distance between said first channel edge and said second channel edge increases from said first and second points to said outer blade edge.

10. The device of claim 1, wherein said opening has a maximum opening width and a distance between said first point and said second point is less than said maximum opening width.

11. The device of claim 1, wherein said cleaning implement is of sponge material.

12. The device of claim 1, wherein said cleaning implement is of layered mesh material.

13. The device of claim 1, further comprising first and second channel ridges integrally formed with an underside of each respective first and second channels.

14. The device of claim 13, further comprising first and second circumferential ridges each extending respectively from said first and second channel ridges and formed integrally with an underside of the blade.

15. The device of claim 13, further comprising first and second ramp sections each extending respectively from the first and second circumferential ridges, each ramp section having a ramping face extending from a surface on each circumferential ridge, the surface being distal from the underside of the blade, and each ramping face ramping progressively closer to the underside and smoothly terminating at the underside.

16. A device for holding a cleaning implement having a compressible main body portion comprising:

a handle;

a cleaning implement, wherein said compressible main body is made of a material selected from a group consisting of a mesh material, a layered sponge, a contoured sponge, and a round sponge;

and a blade attached to said handle and having oppositely oriented first and second blade faces, an outer blade edge surrounding said blade, an opening through said blade defined by an inner blade edge, and a channel through said blade and extending from said inner blade edge to said outer blade edge, said channel being defined by a first channel edge and a second channel edge;

whereby a compressible main body portion of said cleaning implement passes through said channel into said opening and is held in said opening by engagement with said inner blade edge and said first and second blade faces.

17. The device of claim 16 wherein said opening is substantially circular.

18. The device of claim 16 wherein said blade is flexible.

19. The device of claim 16 wherein said handle extends from said first blade edge and has a handle longitudinal axis and wherein said channel has a channel central axis, and further wherein said channel central axis is at a substantial angle to a line extending through said handle longitudinal axis.

* * * * *